US005933692A

United States Patent [19]

Niwano et al.

[11] Patent Number: 5,933,692

[45] Date of Patent: Aug. 3, 1999

[54] DEVELOPER REGULATING MEMBER WITH ELASTIC LAYER SUPPORTING SECTION HAVING HIGH ELASTIC LIMIT VALUE AND DEVELOPING APPARATUS USING THE SAME

[75] Inventors: Kentaro Niwano, Yamato; Masahiro Watabe, Yokohama; Arihiro Yamamoto, Tokyo, all of Japan

[73] Assignee: Canon Kabushiki Kaisha, Tokyo, Japan

[21] Appl. No.: 08/869,739

[22] Filed: Jun. 5, 1997

[30] Foreign Application Priority Data

Jun. 10, 1996 [JP] Japan ..... 8-170543

[51] Int. Cl.[6] ..... G03G 15/08

[52] U.S. Cl. ..... 399/284

[58] Field of Search ..... 399/284, 351, 399/274, 275; 118/261, 413; 428/159, 465

[56] References Cited

U.S. PATENT DOCUMENTS

| | | | |
|---|---|---|---|
| 4,406,535 | 9/1983 | Sakamoto et al. | 399/274 |
| 4,566,402 | 1/1986 | Shimazaki | 399/284 |
| 4,656,965 | 4/1987 | Hosoya et al. | 399/284 |
| 4,748,472 | 5/1988 | Mukai et al. | 399/283 |
| 5,119,755 | 6/1992 | Beisswanger | 118/123 |
| 5,353,104 | 10/1994 | Kato et al. . | |
| 5,412,458 | 5/1995 | Kamaji et al. | 399/272 |
| 5,587,551 | 12/1996 | Ikegawa et al. | 399/1 |
| 5,587,776 | 12/1996 | Watabe et al. . | |
| 5,689,783 | 11/1997 | Sasame et al. . | |

FOREIGN PATENT DOCUMENTS

| | | |
|---|---|---|
| 6-186831 | 7/1994 | Japan . |
| 6-258926 | 9/1994 | Japan . |

*Primary Examiner*—Robert Beatty

*Attorney, Agent, or Firm*—Fitzpatrick, Cella, Harper & Scinto

[57] ABSTRACT

A developer regulating blade for regulating the amount of toner on a developing roll in an electrostatic image forming apparatus includes and elastic member that forms a nip in cooperation with the developing roll. A supporting member of the regulating blade includes a section that supports the elastic member and another section which does not support the elastic member. The elastic member supporting section has a higher elastic limit than the non-supporting section.

18 Claims, 5 Drawing Sheets

DEVELOPER REGULATING MEMBER WITH ELASTIC LAYER SUPPORTING SECTION HAVING HIGH ELASTIC LIMIT VALUE AND DEVELOPING APPARATUS USING THE SAME

BACKGROUND OF THE INVENTION

1. Field of the Invention

The present invention relates to developing apparatuses which are used in image forming apparatuses, such as copying machines and printers, for developing electrostatic images on image holding members, and also relates to developer regulating members used in the developing apparatuses.

2. Description of the Related Art

Developing of electrostatic images on image holding members with powdery toner as developer has been practically performed. In a developing apparatus for this type of developing, an amount of toner on a developing sleeve is regulated by a regulating blade. The developer regulating blade generally comprising a elastic plate is fixed above a developing sleeve in a developing container and is flexibly pressed into contact with a surface of the developing sleeve in a direction opposite to the rotation direction of the developing sleeve. The toner thickness on the developing sleeve is regulated to form a thin toner coating layer by passing through a nip section between the developing sleeve and the regulating blade, and is triboelectrically charged to develop a latent image by friction with the nip section.

Rubber and metal plates have been used as regulating blades. Rubber regulating blades exhibit inferior durability due to plastic deformation caused by aging over long periods of use. Metal regulating blades are extremely difficult to adjust so that the blade comes in contact with the developing sleeve and the toner thereon with a suitably low contact pressure.

Japanese Unexamined Patent Publication No. 6-258,926 discloses a multilayer regulating blade shown in FIG. 6, which includes an elastic layer 4*a* composed of rubber or the like and a supporting layer 4*b* composed of a thin metal plate, which supports the elastic layer 4*a* at the longitudinal end along the transverse direction. The elastic layer 4*a* on the regulating blade 4 comes in contact with the developing sleeve surface to regulate an amount of toner on the developing sleeve, and the supporting layer 4*b* on the regulating blade 4 controls the flexibility of the regulating blade 4 and thus the contact pressure of the elastic layer 4*a* on the developing sleeve. A regulating blade that includes a supporting layer and an elastic layer which have different functions has been effectively used.

However, new toner development trends toward finer particles and sharp melting characteristics require new technology for forming a thinner toner layer on a developing sleeve with further reduced contact pressure between the regulating blade and the developing sleeve. Light contact of the regulating blade 4 can be achieved by decreasing bending strength (stiffness), which is defined in "Method of Bond Test for Metallic Materials: JIS Z2248, push bending test", of the supporting layer 4*b* composed of, for example, a metal foil, of the regulating blade 4. A decreased bending strength of the supporting layer 4*b*, however, causes the supporting layer 4*b* to be less durable and thinner or softer. Since the supporting layer 4*b* is more elastic with decreased bending strength, the elastic layer 4*a* cannot be evenly provided on the supporting layer 4*b*, and thus the surface of the elastic layer 4*a* at the side in contact with toner is not smooth.

Therefore, the regulating blade 4 does not regulate to uniformly apply the toner on the developing sleeve 4, and irregular image density and white lines result. Accordingly, the supporting layer 4*a* of the conventional regulating blade 4 requires a large bending strength.

SUMMARY OF THE INVENTION

It is an object of the present invention to provide a developer regulating member comprising an elastic member having a highly smooth surface.

It is another object of the present invention to provide a developer regulating member and a developing apparatus in which an elastic member can contact a developer carrying member with light pressure.

In accordance with one aspect of the present invention, a developer regulating member includes: an elastic member for forming a nip with the cooperation of a developer carrying member, and a supporting member for supporting the elastic member at a partial section; wherein an elastic member supporting section of the supporting member has a higher elastic limit value than the other section of the supporting member.

Another aspect of the present invention relates to a developing apparatus using the developer regulating member set forth above.

Other and further objects, features and advantages of the present invention will appear more fully from the following description.

DETAILED DESCRIPTION OF THE PREFERRED EMBODIMENTS

The present invention will now be described in detail with reference to the drawings.

Figure 1:
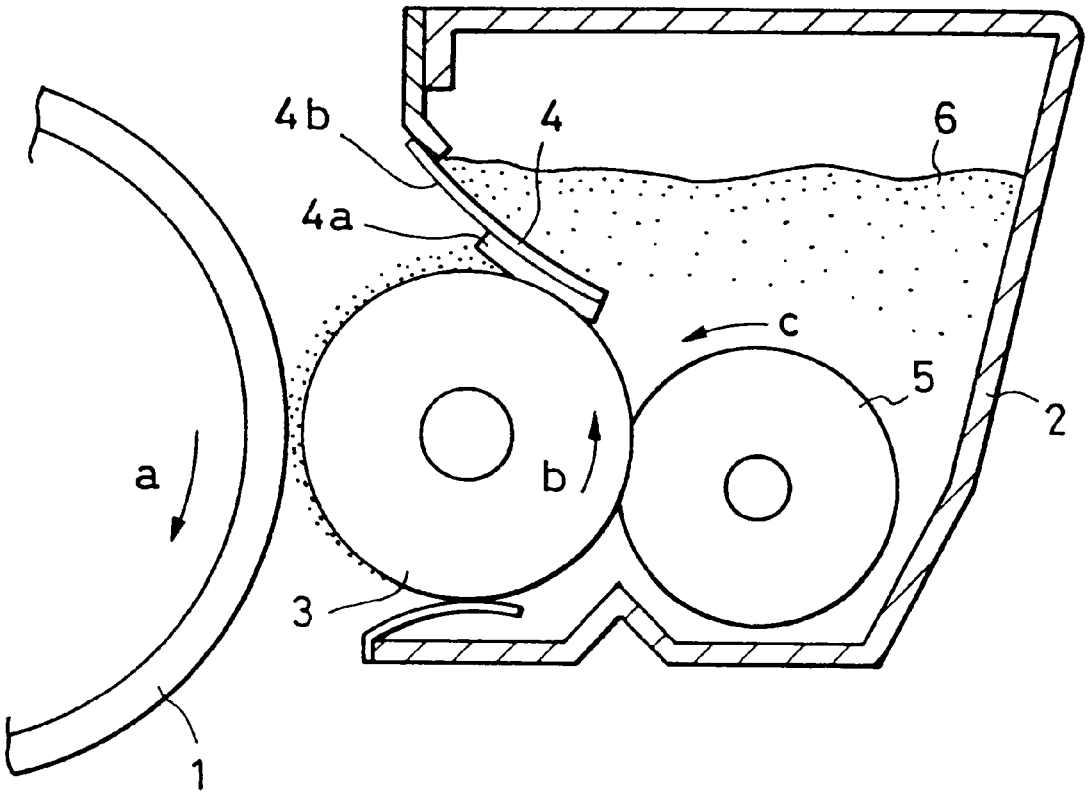
FIG. 1 is an outline cross-sectional view of an embodiment of a developing apparatus in accordance with the present invention.
Figure 2:
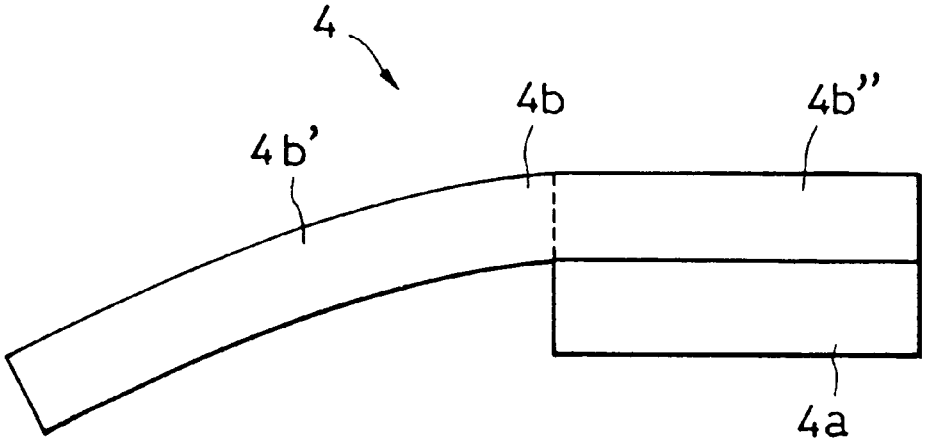
FIG. 2 is a cross-sectional view of a regulating blade provided in the developing apparatus of FIG. 1.

FIG. 1 is an outline cross-sectional view illustrating an embodiment of a developing apparatus in accordance with the present invention, and FIG. 2 is a cross-sectional view of a regulating blade which is provided in the developing apparatus shown in FIG. 1.

A regulating blade as a regulating member in accordance with the present invention, which is provided in the developing apparatus shown in FIG. 1, includes a supporting layer 4*b* as a supporting member and an elastic layer 4*a* as an elastic member. The elastic layer 4*a* is provided on the supporting layer 4*b* such that a surface of the elastic layer 4*a* at the side in contact with a rotating developing sleeve 3 is smooth and the elastic layer 4*a* comes in contact with the developing sleeve 3 with light pressure. Therefore, the developer regulating blade 4 preferably has a configuration as shown in FIG. 2.

In the developer regulating blade 4 in accordance with the present invention as shown in FIG. 2, the supporting layer 4*b* includes a section 4*b*', which is free from the elastic layer 4*a*, and a section 4*b*", which is provided with the elastic layer 4*a*. The section 4*b*' controls the pressure of the developer regulating blade 4, i.e., the contact pressure of the elastic layer 4*a* with the developing sleeve. The section 4*b*' has a relatively smaller elastic limit value compared to the section 4*b*".

Figure 6:
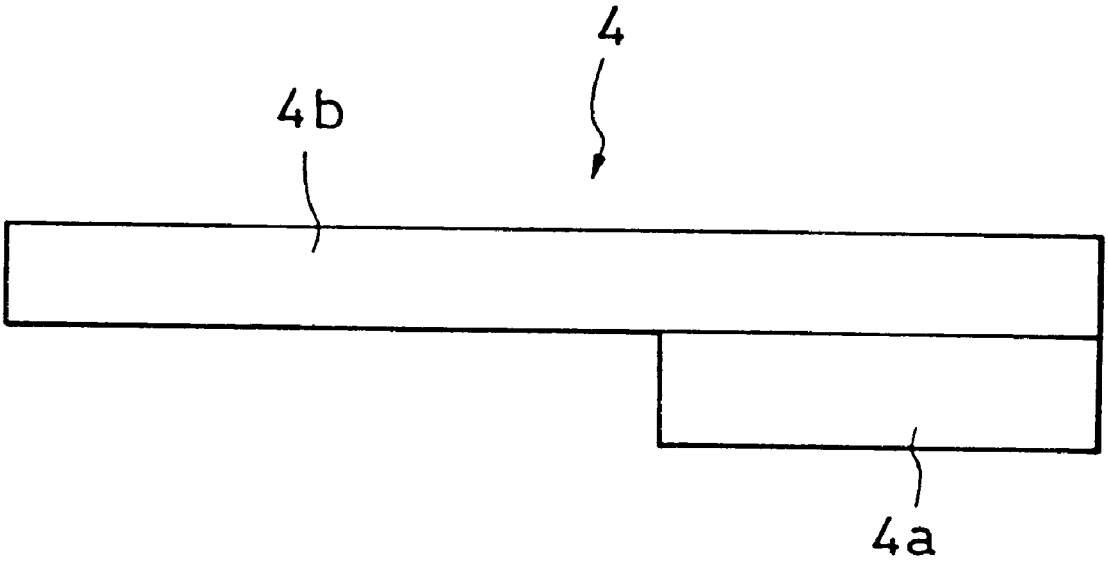
FIG. 6 PRIOR ART
FIG. 6 is a cross-sectional view of a conventional regulating blade.

A conventional regulating blade 4 as shown in FIG. 6 for comparison has a single elastic layer configuration having a uniform elastic limit value, in which a supporting layer 4*b* is not divided into a section which is free from the elastic layer and a section which is provided with the elastic layer.

As used herein, "elastic limit value" is determined by the process in which gradually increased stresses are repeatedly applied to a free end of a cantilevered sample to accumulate strain in the free end and to form a permanent set. The elastic limit value means a surface fiber stress applied to a fixed end of the cantilevered sample when the permanent set reaches a predetermined value.

The section 4*b*' of the supporting layer 4*b* preferably has a flexural modulus sufficient to prevent permanent set of the section 4*b*' due to the contact pressure of the elastic layer 4*a* with the developing sleeve for long time periods. Also, the section 4*b*' preferably has a low bending strength so that the elastic layer 4*a* can come in contact with the developing sleeve and the toner thereon with light pressure.

The section 4*b*" of the supporting layer must have a relatively high stiffness in order to enable application of pressure for thermal bonding between the elastic layer 4*a* and the supporting layer 4*b* and to maintain or form a mirror surface at the face of the elastic layer 4*a* in contact with the developing sleeve. Therefore, the section 4*b*" has a higher bending strength relative to the section 4*b*'.

Preferable materials for the supporting layer 4*b* including the sections 4*b*' and 4*b*" include flat metal plates made of stainless steel, phosphor bronze and aluminum, having a thickness of 20 to 500 $\mu$m in view of pressure control to the developing sleeve; and a flat resin plate having elastic resilience made of polyethylene, polycarbonate and stretched polypropylene having a thickness of 50 to 100 $\mu$m.

Usable materials for the elastic layer 4*a* include high temperature curing type millable silicone rubbers (HTV), thermoplastic urethane rubbers, liquid urethane rubbers, liquid nitrile-butadiene rubbers and liquid silicone rubbers (LTV and RTV), modified polymers thereof and mixtures thereof. A preferable shape of the elastic layer 4*a* made of such an elastic material is a flat plate having a thickness of 0.1 to 2.5 mm.

Typical embodiments of the regulating blade in accordance with the present invention are shown in FIGS. 3A through 3C and FIGS. 4A and 4B.

Figure 3A:
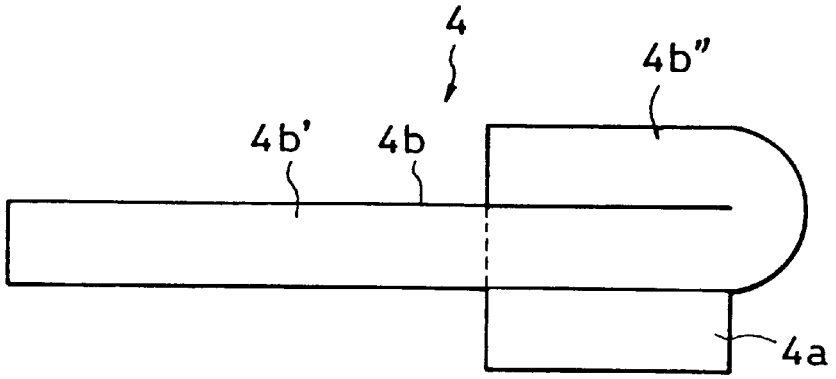
FIGS. 3A through 3C are cross-sectional views of other embodiments of a developer regulating blade in accordance with the present invention.

A supporting layer 4*b* of a regulating blade 4 shown in FIG. 3A has a double-layered section 4*b*" which is formed by folding the supporting layer 4*b* at the side opposite the elastic layer 4*a* so as to cover the entire elastic layer 4*a*. A supporting layer 4*b* of a regulating blade 4 shown in FIG. 3B also has a double-layered section 4*b*", but the supporting layer 4*b* is folded toward the elastic layer 4*a*. In a regulating blade shown in FIG. 3C, the section 4*b*" of the supporting layer 4*b* has a triple-layer structure formed by twice folding the supporting layer 4*b* on the side opposite the elastic layer 4*a*. In all the regulating blades shown in FIGS. 3A through 3C, each folded section 4*b*" has a larger elastic limit value relative to its section 4*b*', unless both sections are composed of the same material.

Figure 4A:
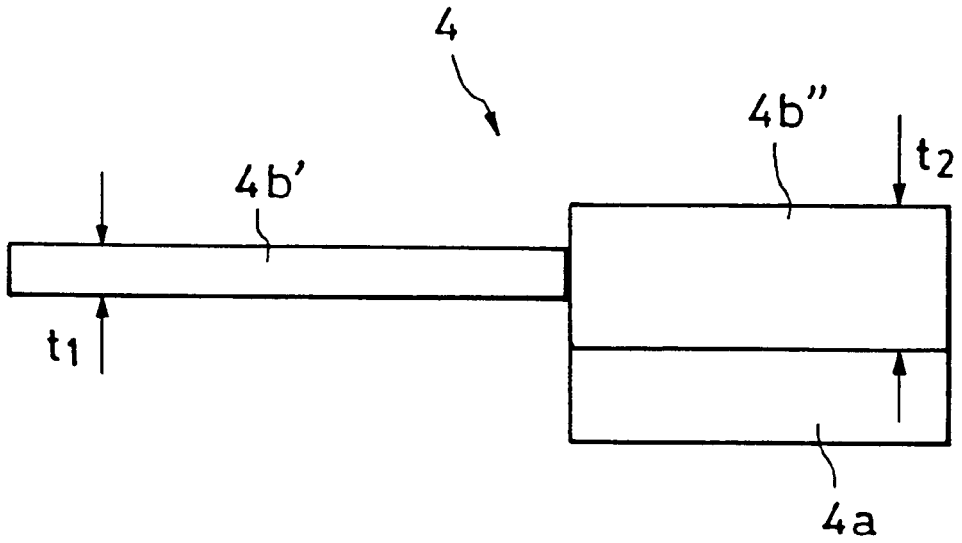
FIGS. 4A and 4B are cross-sectional views of further embodiments of a developer regulating blade in accordance with the present invention.
Figure 4B:
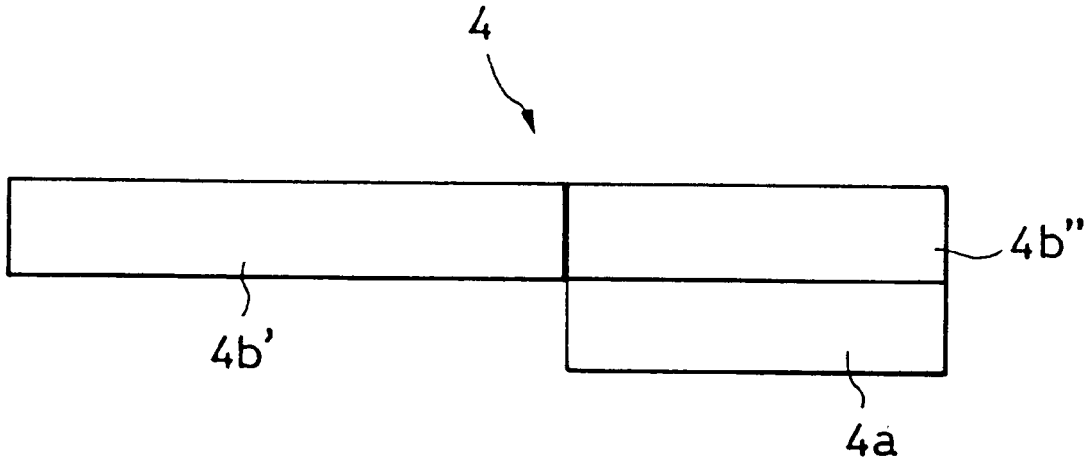

In regulating blades shown in FIGS. 4A, 4B, 5A and 5B, each section 4*b*" also has a larger elastic limit value relative to its section 4*b*'. A supporting layer of a regulating blade 4 shown in FIG. 4A is composed of a section 4*b*' having a thickness $t_1$ and a section 4*b*" having a thickness $t_2$, wherein $t_2$ is larger than $t_1$ and the section 4*b*' and the section 4*b*" are butt-jointed. A supporting layer of a regulating blade 4 shown in FIG. 4B is composed of a section 4*b*' and a section 4*b*", which have the same thickness but are made of different materials, that is, the section 4*b*" has a larger elastic limit value than the section 4*b*'. Both sections are butt-jointed.

Figure 5A:
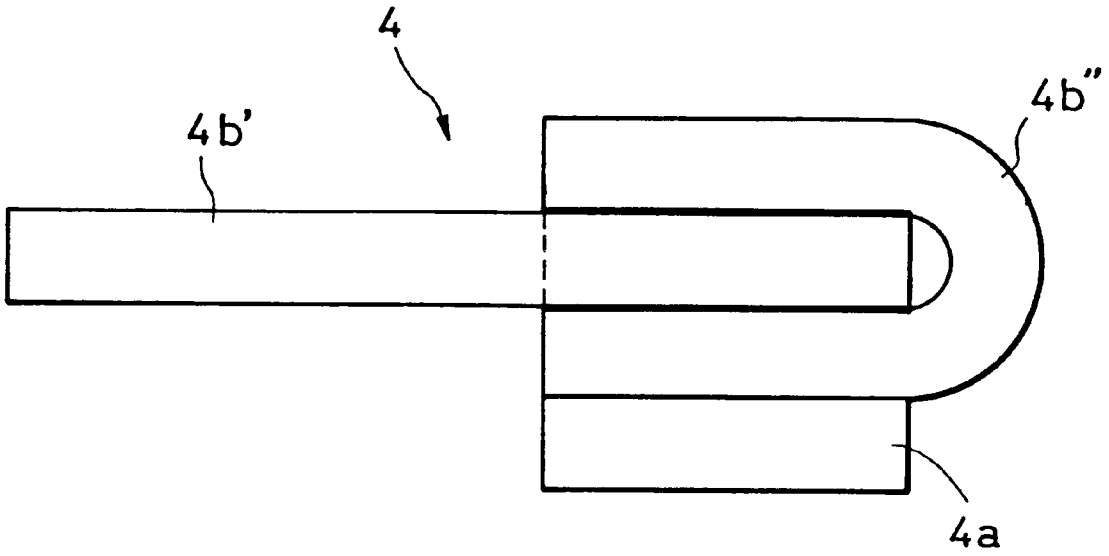
FIGS. 5A and 5B are cross-sectional views of still further embodiments of a developer regulating blade in accordance with the present invention.
Figure 5B:
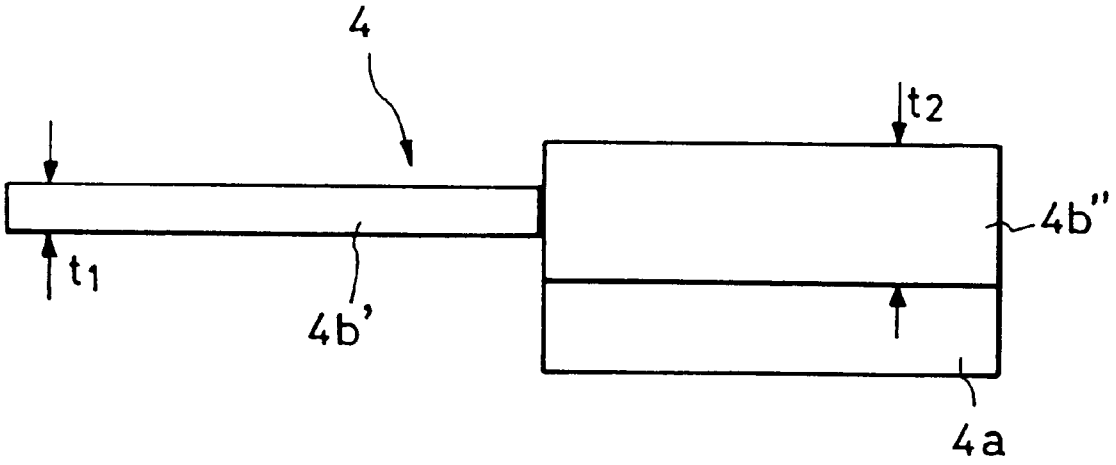

In a regulating blade shown in FIG. 5A, a supporting layer is composed of a first supporting member and a second supporting member which are made of the same material. One end of the first supporting member is a flat plate and acts as a section 4*b*'. The second supporting member wraps around another end of the first supporting member. Both supporting members are bonded to each other to form a section 4*b*". This regulating blade has a higher bond strength compared to the regulating blades shown in FIGS. 4A and 4B. In a regulating blade shown in FIG. 5B, a supporting member is composed of a section 4*b*' having a thickness $t_1$, and a section 4*b*" having a thickness $t_2$, wherein $t_2$ is larger than $t_1$ and the section 4*b*" has a higher elastic limit value than the section 4*b*'.

A method for making a regulating blade in accordance with the present invention will now be described. A typical method for making a regulating blade includes integral press molding of a supporting layer and an elastic layer by means of thermal adhesion in a hot compression mold. Japanese Unexamined Patent Publication No. 6-258,926 discloses such a process for obtaining a regulating blade having a highly smooth surface. A regulating blade in accordance with the present invention, of which the supporting section has a higher elastic limit value than the section, can be produced based on this method, while modifying the structure and material of the supporting layer.

Figure 3B:
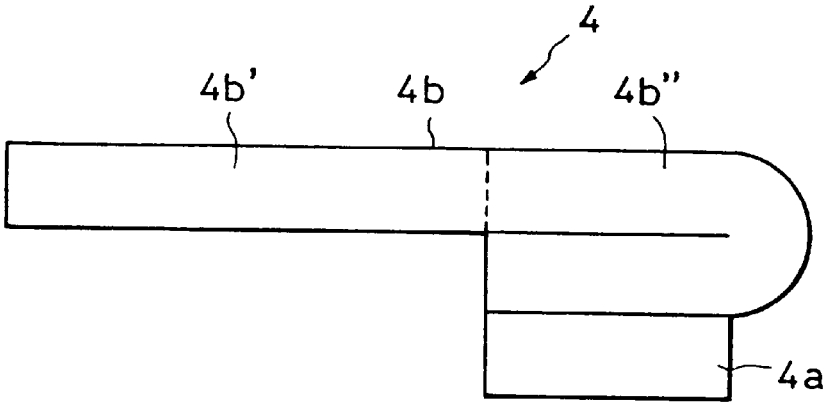
Figure 3C:
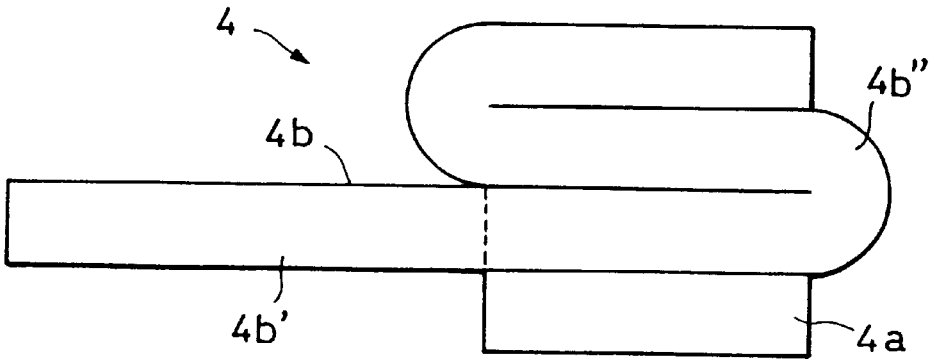

An embodiment of the method will be described in detail with reference to the regulating blade shown in FIGS. 3A or 3B. For example, a SUS304 foil is folded along the longitudinal direction to form a given folded length. An adhesive is applied to the folded side or its opposite side. The folded foil is placed into a mold having a mirror-polished upper surface for hot compression, so that the upper side of the folded foil is the adhesive layer. A predetermined amount of silicone rubber containing a vulcanizer is injected into the mold, and is compression-molded at 160° C. for 20 minutes for primary vulcanization. The molded product comprising the foil and the silicone rubber is transferred to an oven and heated at 200° C. for 4 hours for secondary vulcanization. The molded product is cooled to room temperature and trimmed into a desirable shape and size, if necessary. The regulating blade 4 having a double layered section 4*b*" shown in FIGS. 3A or 3B is obtained in such a manner.

A butt-jointed regulating blade 4 as shown in, for example, FIGS. 4A and 4B can also be produced by a similar process. First, a section 4*b*" having an elastic layer 4*a* is produced by a molding process. The section 4*b*" is butt-jointed with a section 4*b*' by welding, spot welding, soldering, rivetting, injection, crimping or brazing. The following alternative method may also be applicable. After an elastic layer 4*a* is made by hot press molding, centrifugal molding or T-slot extrusion, it is bonded to a section 4*b*".

A developing apparatus in the present invention is provided with a developing container 2, which contains a toner 6 as a nonmagnetic one-component developer, and a rotatable developing sleeve 3 as a toner holding member provided in the developing container 2. In FIG. 1, the right half of the developing sleeve 3 is located inside the opening section of the developing container 2, and the left half is located outside the opening section so as to face a photosensitive drum 1 at a given minute distance. The developing sleeve 3 rotates along an arrow b while the photosensitive drum 1 rotates along an arrow a.

The developing container 2 is provided with a regulating blade 4 and a toner supplying roller 5 made from a cellular material. The regulating blade 4 is attached to the upper opening edge of the developing container 2. The toner supplying roller 5 is located at the right side of the developing sleeve 3 upstream of the regulating blade 3, and rotates along an arrow c (opposite to the direction of rotation of the regulating blade 3).

The regulating blade 4 is composed of an elastic layer 4*a* which comes in contact with the surface of the developing sleeve 3, and supporting layer 4*b* which supports the elastic layer 4*a* at its movable end. The supporting member 4 has a higher elastic limit value at the movable end with the elastic layer 4*a* compared to the end without the elastic layer 4*a*. The regulating blade 4 is attached to the upper opening edge of the developing container 2 with a downward inclination toward the upstream of the direction of rotation of the developing sleeve 3, and the elastic layer 4*a* comes in contact with the surface of the developing sleeve 3 against the rotation of the developing sleeve 3.

The toner supplying roller 5 rotates along the arrow c and carries the toner 6 near to the developing sleeve 3. The toner 6 on the toner supplying roller 5 adheres to the surface of the developing sleeve 3 by friction of the toner 6 at a nip section between the developing sleeve 3 and the toner supplying roller 5. The toner 6 on the developing sleeve 3 enters the nip section between the developing sleeve 3 and the elastic layer 4*a* of the regulating blade 4 with rotation of the developing sleeve 3, and is triboelectrically charged by the friction with the developing sleeve 3 and the elastic member 4*a,* while being adjusted to a given thickness.

After passing through the nip section, the toner 6 on the rotating developing sleeve 3 is carried to the developing section at which the developing sleeve 3 faces the photosensitive drum 1, and a latent image is developed on the photosensitive drum 1 with the toner. A biased ac voltage for developing is applied to between the developing sleeve 3 and the photosensitive drum 1. The toner 6 on the developing sleeve 3 is transferred to the photosensitive drum 1 in response to the latent image on the photosensitive drum 1. The latent image is thereby developed and visualized as a toner image.

The remaining toner, which was not consumed in developing, on the developing sleeve 3 returns to the developing container 2 along rotation of the developing sleeve 3. The remaining toner is scraped by the toner supplying roller 5 from the developing sleeve 3 at the nip section, while supplying fresh toner 6 on the developing sleeve 3. The scraped toner is mixed with toner 6 in the developing container 2 by means of rotation of the toner supplying roller 5, and thus triboelectric charge of the scraped toner is dispersed in the toner 6.

Since the section 4*b*" of the regulating blade 4 has a higher elastic limit value than the section 4*b*', an elastic layer 4*a* can be adhered to the section 4*b*" so as to maintain a smooth surface of the elastic layer 4*a,* and the surface of the elastic layer 4*a* in contact with the developing sleeve 3 can be formed or maintained as a mirror surface. The elastic layer 4*a* can uniformly apply pressure to toner 6 carried on the developing sleeve 3, so that a uniform toner layer is formed on the developing sleeve 3. Accordingly, the developing apparatus in accordance with the present invention can effectively prevent irregular image density and white lines caused by nonuniform toner coating.

Further, a lower elastic limit value at the section 4*b*' can prevent plastic deformation of the regulating blade 4 for a long time period, can regulate toner 6 on the developing sleeve 3 with the elastic layer 4*a* with light pressure, and can prevent toner deterioration due to toner crushing and toner fusion on the developing sleeve 3 and the regulating blade 4.

Accordingly, the developing apparatus in accordance with the present invention is capable of using fine toner and color toner and obtaining a high quality image without low density, fogging and irregular uncopied spots for long time periods.

EXAMPLES

The present invention will now be described in more detail with reference to Examples.

Example 1

A SUS304H foil (Cold Rolled Stainless Steel Strip for Springs made by Nisshin Steel Co., Ltd.) having a thickness 0.06 mm, a width of 20 mm and a length of 300 mm was folded along the length to form a 5 mm folded section. The folded section was set downward. A primer for silicone rubber (DY39-067 made by Dow Corning Toray Silicone Co., Ltd.) was applied to the reverse side (upper side) of the folded section. The primer applied section was placed into a mold having a mirror polished upper wall for an injection machine (made by Matsuda Seisakusho, Co., Ltd.). A liquid silicone rubber (DY35-446 made by Dow Corning Toray Silicone Co., Ltd.) was injected into the mold and heated at 120° C. for 15 minutes. After primary vulcanization, the SUS foil with silicon rubber was removed from the mold and heated in a oven at 200° C. for 4 hours for secondary vulcanization. The foil with silicon rubber was cooled to room temperature. A regulating blade 4 shown in FIG. 3A was prepared. The regulating blade 4 is composed of a section 4*b*' without an elastic layer 4*a* having a thickness of 0.06 mm, a width of 15 mm and a length of 200 mm, and a double-layered section 4*b*" with an elastic layer 4*a* having a thickness of 0.12 mm, a width of 5 mm and a length of 200 mm.

The regulating blade 4 was installed in a developing apparatus shown in FIG. 1, and subjected to an image formation test of 10,000 copying cycles using a laser beam printer. The results are shown in Table 1. In Table 1, irregularity of image density was evaluated by uncopied spots in an entire solid black image, and white line phenomenon was evaluated by white lines in an entire solid black image.

TABLE 1

| | Example 1 | Example 2 | Comparative Example 1 | Comparative Example 2 |
|---|---|---|---|---|
| Material of Supporting layer | SUS304 | SUS304 | SUS304 | SUS304 |
| Structure | Folded end | Jointed Flat plate | Flat plate | Flat plate |
| Thickness of supporting layer | 4b' = 0.06 mm 4b" = 0.12 mm | 4b' = 0.06 mm 4b" = 0.18 mm | 4b' = 4bΔ = 0.18 mm | 4b' = 4b" = 0.03 mm |
| Elastic limit value | 4b' < 4b" | 4b' < 4b" | 4b' = 4b" | 4b' = 4b" |
| Blade pressure | Low | Low | High | Low |
| Surface smoothness of elastic layer | Excellent | Good | Excellent | Unsatisfactory |
| Image density | Excellent | Good | Irregular | Slightly irregular |
| White line | Not observed | Slightly observed | Fairly noticeable | Unsatisfactorily noticeable |

Example 2

A SUS304H foil having a thickness $t_1$ of 0.06 mm, a width of 10 mm and a length of 300 mm was used as a section 4*b*' of a regulating blade 4 shown in FIG. 4A, and a SUS304H foil having a thickness $t_2$ of 0.18 mm, a width of 5 mm and a length of 300 mm was used as a section 4*b*" of the regulating blade 4. An elastic layer 4*a* was formed on a surface of the latter SUS foil for the section 4*b*" by a similar molding process as in Example 1, and butt-jointed with the former SUS foil by welding to make a regulating blade 4 shown in FIG. 4A.

The regulating blade 4 was installed into a developing apparatus shown in FIG. 1, and subjected to an image formation test of 10,000 copying cycles using a laser beam printer as in Example 1. The results are shown in Table 1.

Comparative Example 1

A SUS304H foil having a thickness of 0.18 mm, a width of 20 mm and a length of 300 mm was prepared and an elastic layer 4*a* was formed on the end of the foil along the longitudinal direction corresponding to the 5 mm end as in Example 1. A regulating blade 4 shown in FIG. 6 was produced.

The regulating blade 4 was installed in a developing apparatus shown in FIG. 1, and subjected to an image formation test of 10,000 copying cycles using a laser beam printer as in Example 1. The results are shown in Table 1.

Comparative Example 2

A SUS304H foil having a thickness of 0.03 mm, a width of 20 mm and a length of 300 mm was prepared and an elastic layer 4*a* was formed on the end of the foil along the longitudinal direction corresponding to the 5 mm end as in Example 1. A regulating blade 4 shown in FIG. 6 was produced.

The regulating blade 4 was installed in a developing apparatus shown in FIG. 1, and subjected to an image formation test of 10,000 copying cycles using a laser beam printer as in Example 1. The results are shown in Table 1.

Table 1 demonstrates that both regulating blades 4 in Examples 1 and 2 can achieve high quality images without image density irregularity and white lines and the regulating blade 4 in Example 1 exhibits particularly satisfactory results. In contrast, the regulating blade 4 in Comparative Example 1 excessively regulates the toner thickness on the developing sleeve 3 in spite of a mirror-polished surface of the elastic layer 4*a,* because contact pressure of the elastic layer 4*a* with the developing sleeve 3 increases due to a relatively thicker supporting layer 4*b*. Thus, the resulting image exhibits irregular densities. In the regulating blade 4 in Comparative Example 2, a relatively low thickness of the supporting layer 4*b* does not achieve a satisfactory mirror-polished surface of the elastic layer 4*a,* and the resulting image has many white lines due to the rough surface.

Differences between Examples 1 and 2 and Comparative Examples 1 and 2 were demonstrated to be further remarkable in additional image formation tests.

As set forth above, the regulating blade in accordance with the present invention is composed of two sections, i.e., a control section not having an elastic layer and a contact section having an elastic layer. The control section has a lower elastic limit value compared to the contact section. Thus, the regulating blade comes in contact with a developing sleeve with light pressure and can moderately regulate toner on the developing sleeve. Therefore, toner crushing and toner fusion to the developing sleeve and the regulating blade can be prevented when using highly durable fine particle toner or color toner, and a thin toner layer can be formed on the developing sleeve.

Since the elastic limit value of the contact section of the supporting layer is relatively high, the elastic layer having a highly smooth surface can be bonded to the supporting layer and the surface of the elastic layer in contact with the developing sleeve can be formed or maintained as a mirror surface. The elastic layer can uniformly apply toner on the developing sleeve. Thus, the regulating blade can effectively prevent irregular image density and white lines which are caused by nonuniform toner coating.

Accordingly, the present invention is capable of using fine toner and color toner and obtaining a high quality image without low density, fogging and irregular uncopied spots for long time periods.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developer regulating member comprising:

a supporting member; and an elastic layer arranged on an end section of said supporting member, wherein said supporting member comprises a supporting section on which said elastic layer is arranged and a non-supporting section on which said elastic layer is not arranged, and wherein the supporting section has a higher elastic limit value than an elastic limit of the non-supporting section.

2. A developer regulating member according to claim 1, wherein said supporting member comprises a metal plate, and an elastic limit value of said elastic member supporting section is increased by folding said metal plate.

3. A developer regulating member according to claim 2, wherein said elastic member is provided on a face of the folded side of the metal plate.

4. A developer regulating member according to claim 2, wherein said elastic member is provided on a side opposite to a face of the folded side of the metal plate.

5. A developer regulating member according to claim 1, wherein the elastic member supporting section is made of a material having a higher elastic limit value compared to an elastic limit value of a material of the non-supporting section.

6. A developer regulating member according to claim 1, wherein said elastic member is connected to said supporting member by thermal press molding.

7. A developer regulating member according to claim 1, wherein said elastic member is bonded to said supporting member.

8. A developer regulating member comprising an elastic member for forming a nip in cooperation with a developer carrying member, and a supporting member including a section for supporting said elastic member, wherein said supporting member has an increased thickness at the elastic member supporting section than at a non-supporting section.

9. A developing apparatus comprising:

a developer carrying member for carrying a developer, and a regulating member for regulating an amount of said developer on said developer carrying member;

said regulating member comprising an elastic member for forming a nip in cooperation with said developer carrying member, and a supporting member including a section for supporting said elastic member and at least one other section;

wherein said supporting member has an increased thickness at said elastic member supporting section than at said at least one other section.

10. A developer regulating member comprising an elastic member for forming a nip in cooperation with a developer carrying member, and a supporting member including a section for supporting said elastic member;

wherein both a dimension corresponding to a thickness and a dimension corresponding to a length of the elastic member supporting section of said supporting member are greater than a dimension corresponding to a thickness at a non-supporting section of said supporting member.

11. A developing apparatus comprising:

a developer carrying member for carrying a developer;

a regulating member for regulating an amount of the developer on said developer carrying member;

said regulating member comprising an elastic member for forming a nip in cooperation with said developer carrying member and a supporting member for supporting a part of said elastic member, said supporting member having a supporting section on which said elastic layer is disposed, and a non-supporting section on which said elastic layer is not disposed, wherein the supporting section has a higher elastic limit value than the non-supporting section; and a fixing member for fixing the non-supporting section.

12. A developing apparatus according to claim 11, wherein said developer is a nonmagnetic one-component developer.

13. A developing apparatus according to claim 11, wherein said supporting member comprises a metal plate, and the elastic limit value of said elastic member supporting section is increased by folding said metal plate.

14. A developing apparatus according to claim 13, wherein said elastic member is provided on a face of the folded side of the metal plate.

15. A developing apparatus according to claim 13, wherein said elastic member is provided on the opposite side to a face of the folded side of the metal plate.

16. A developing apparatus according to claim 11, wherein a material used for the elastic member supporting section has a higher elastic limit value compared to the an elastic limit value of a material used for the non-supporting section.

17. A developing apparatus according to claim 11, wherein said elastic member is connected to said supporting member by thermal press molding.

18. A developing apparatus according to claim 11, wherein said elastic member is bonded to said supporting member.

* * * * *

UNITED STATES PATENT AND TRADEMARK OFFICE

CERTIFICATE OF CORRECTION

PATENT NO. : 5,933,692

DATED : August 3, 1999

INVENTOR(S) : KENTARO NIWANO, ET AL.

It is certified that error appears in the above-identified patent and that said Letters Patent is hereby corrected as shown below:

COVER SHEET
[57] Abstract
Line 3, "and" should read --an--.

COLUMN 1,
Line 38, "No. 6-258,926" should read --No. 6-258926--.

COLUMN 4,
Line 35, "No. 6-258,926" should read --No. 6-258926--.

COLUMN 5,
Line 48, "ac" should read --AC--.

COLUMN 7,
TAB 1, "4bΔ" should read --4b--.

COLUMN 10,
LINE 40, "the" should be deleted.

Signed and Sealed this

Sixth Day of June, 2000

*Attest:*

Q. TODD DICKINSON

*Attesting Officer*

*Director of Patents and Trademarks*